US009719512B2

(12) United States Patent
Takashima et al.

(10) Patent No.: US 9,719,512 B2
(45) Date of Patent: Aug. 1, 2017

(54) HERMETICALLY SEALED ROTARY COMPRESSOR AND REFRIGERATION CYCLE DEVICE

(71) Applicant: TOSHIBA CARRIER CORPORATION, Minato-ku, Tokyo (JP)

(72) Inventors: Kazu Takashima, Fuji (JP); Koji Satodate, Fuji (JP); Toshimasa Aoki, Fuji (JP)

(73) Assignee: TOSHIBA CARRIER CORPORATION, Tokyo (JP)

( * ) Notice: Subject to any disclaimer, the term of this patent is extended or adjusted under 35 U.S.C. 154(b) by 0 days.

(21) Appl. No.: 13/861,203

(22) Filed: Apr. 11, 2013

(65) Prior Publication Data

US 2013/0219952 A1 Aug. 29, 2013

Related U.S. Application Data

(63) Continuation of application No. PCT/JP2011/073424, filed on Oct. 12, 2011.

(30) Foreign Application Priority Data

Oct. 13, 2010 (JP) ..... 2010-230793

(51) Int. Cl.
*F01C 21/18* (2006.01)
*F01C 1/063* (2006.01)
(Continued)

(52) U.S. Cl.
CPC ..... *F04C 23/02* (2013.01); *F01C 21/007* (2013.01); *F01C 21/02* (2013.01); *F01C 21/10* (2013.01);
(Continued)

(58) Field of Classification Search
CPC ..... F01C 21/007; F01C 21/02; F01C 21/10; F04B 39/023; F04B 39/16; F04C 2230/604; F04C 2240/805; F04C 29/06
(Continued)

(56) References Cited

U.S. PATENT DOCUMENTS 3,031,861 A * 5/1962 McCormack ..... 62/196.3
4,946,351 A * 8/1990 Richardson, Jr. ..... F01C 21/007 248/27.3
(Continued)

FOREIGN PATENT DOCUMENTS

JP 61-70180 A 4/1986
JP 61-160295 U 10/1986
(Continued)

OTHER PUBLICATIONS

Modeling of Compressor Vibration for Improved Dynamic Design, Padmanabhan, C. International Compressor Engineerng Conference, Purdue University, 1996.*
(Continued)

*Primary Examiner* — Deming Wan
(74) *Attorney, Agent, or Firm* — Holtz, Holtz & Volek PC

(57) ABSTRACT

The height measured from the bottom surfaces of support legs is set to be 2.5 or more times as great as the outer diameter of the compressor body, the height of the center of gravity measured from the bottom surfaces of the support legs to the center of gravity is set to be ½ or less the overall height, and the support legs are provided in number of four, based on the fulfillment of Rc/cos θ<Rb<L. Here Rb is the support point radius of the compressor body, Rc is the outer radius of the compressor body, L is the distance from a longitudinal central axis of the compressor body to a lon-
(Continued)

gitudinal central axis of an accumulator, and θ is an angle half the angle formed between the adjacent support legs about the central axis.

5 Claims, 6 Drawing Sheets

(51) Int. Cl.

| | |
|---|---|
| ***F04C 23/02*** | (2006.01) |
| ***F01C 21/00*** | (2006.01) |
| ***F01C 21/02*** | (2006.01) |
| ***F01C 21/10*** | (2006.01) |
| ***F04B 39/12*** | (2006.01) |
| ***F04B 39/16*** | (2006.01) |
| ***F04C 23/00*** | (2006.01) |
| ***F04C 28/28*** | (2006.01) |
| ***F04B 39/02*** | (2006.01) |
| ***F04B 39/14*** | (2006.01) |
| *F04C 18/356* | (2006.01) |

(52) U.S. Cl.
CPC ..... *F04B 39/023* (2013.01); *F04B 39/121* (2013.01); *F04B 39/14* (2013.01); *F04B 39/16* (2013.01); *F04C 23/008* (2013.01); *F04C 28/28* (2013.01); *F04C 18/356* (2013.01); *F04C 2230/604* (2013.01); *F04C 2240/805* (2013.01)

(58) Field of Classification Search
USPC ..... 418/150, 191–200, 259, 179, 60; 417/363, 365, 312, 360; 181/403
See application file for complete search history.

(56) References Cited

U.S. PATENT DOCUMENTS

| | | | | |
|---|---|---|---|---|
| 5,037,278 | A * | 8/1991 | Fujio et al. | 418/55.2 |
| 5,213,490 | A * | 5/1993 | Yamamoto et al. | 418/55.6 |
| 2004/0165999 | A1* | 8/2004 | Tadano et al. | 417/312 |
| 2007/0154334 | A1* | 7/2007 | Amano | 417/424.1 |
| 2008/0219865 | A1* | 9/2008 | Hodapp et al. | 417/363 |
| 2010/0122549 | A1* | 5/2010 | Cho et al. | 62/469 |
| 2012/0174620 | A1* | 7/2012 | Takashima | F04C 18/3564 62/498 |

FOREIGN PATENT DOCUMENTS

| | | | |
|---|---|---|---|
| JP | 61-164966 | U | 10/1986 |
| JP | 2005-55106 | A | 3/2005 |
| JP | 2005-061350 | A | 3/2005 |
| JP | 2008-075475 | A | 4/2008 |
| JP | 2010-77875 | A | 4/2010 |

OTHER PUBLICATIONS

Chapter 10, Vessel, ICARUS Corporation 1998.*
Sanyo Scroll Compressors for Commercial Air Conditioning, Sanyo Electric Co. Ltd. Jan. 1, 2003.*
International Preliminary Report on Patentability (IPRP) and Written Opinion dated May 16, 2013 (in English) issued in parent International Application No. PCT/JP2011/073424.
International Search Report (ISR) dated Jan. 17, 2012 (and English translation thereof) issued in parent International Application No. PCT/JP2011/073424.

* cited by examiner

HERMETICALLY SEALED ROTARY COMPRESSOR AND REFRIGERATION CYCLE DEVICE

CROSS REFERENCE TO RELATED APPLICATIONS

This application is a Continuation Application of PCT Application No. PCT/JP2011/073424, filed Oct. 12, 2011 and based upon and claiming the benefit of priority from Japanese Patent Application No. 2010-230793, filed Oct. 13, 2010, the entire contents of all of which are incorporated herein by reference.

FIELD

Embodiments of the present invention relate to a hermetically sealed rotary compressor and a refrigeration cycle device comprising the hermetically sealed rotary compressor and constituting a refrigeration cycle.

BACKGROUND

A hermetically sealed rotary compressor that constitutes a refrigeration cycle device comprises a compressor body configured so that an electric motor unit is accommodated in an upper part of a well-closed container and a compression mechanism section, which is driven by the electric motor unit through a shaft, is accommodated in a lower end portion of the well-closed container. An accumulator is attached to a side surface of the well-closed container by a mounting fixture, and support legs are disposed on the lower end portion of the well-closed container.

While the compressor body and accumulator are formed in a circular shape in a plan view, the support legs are usually formed in a triangular shape in a plan view. The respective vertical angle portions of the support legs project from the peripheral surface of the well-closed container, and these vertical angle portions are formed individually with mounting holes through which fixtures are passed to be attached and secured to mounting spots (see Patent Documents 1 and 2, for example).

DETAILED DESCRIPTION

Figure 1:
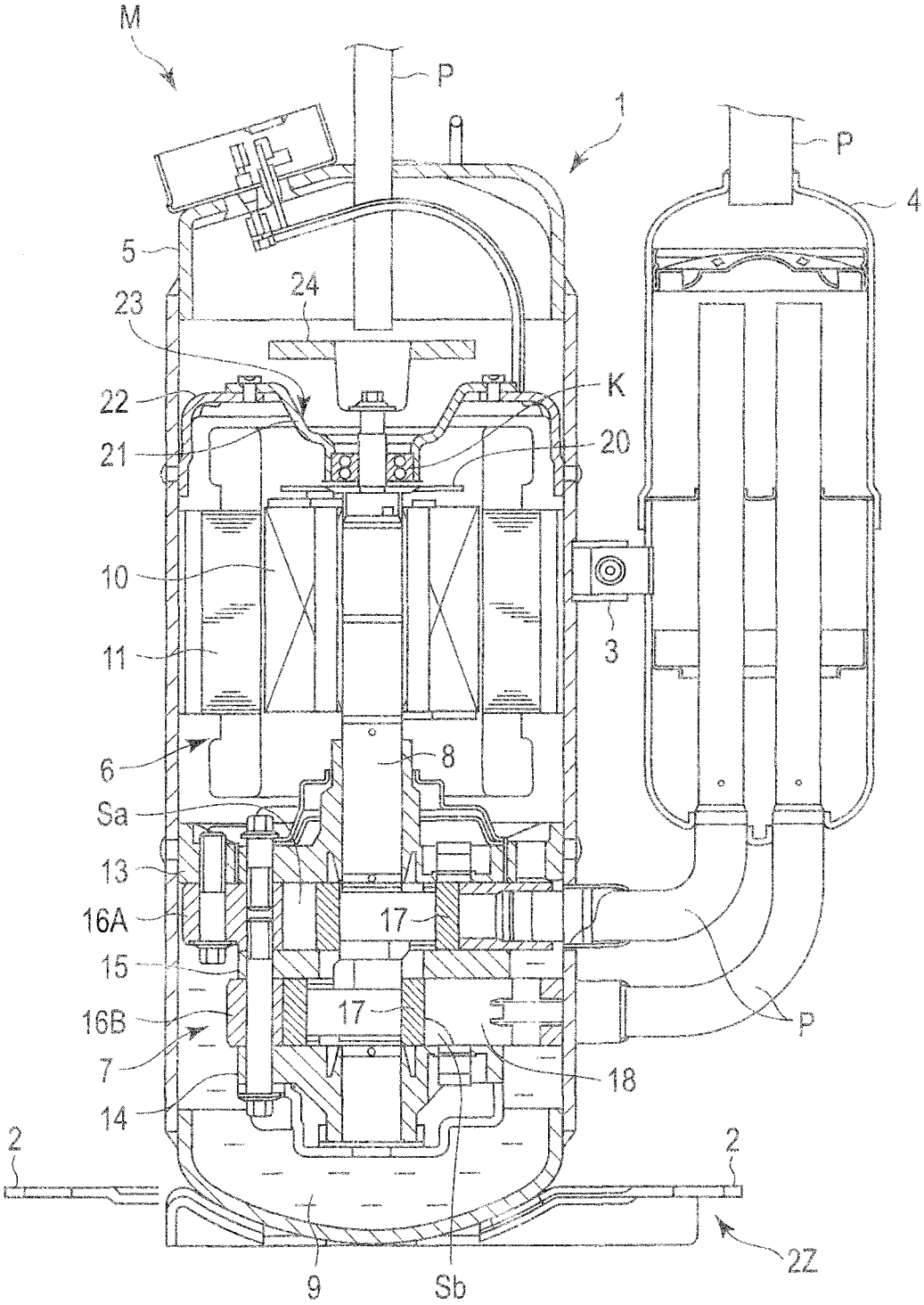
FIG. 1 is a schematic longitudinal sectional view of a hermetically sealed rotary compressor according to the present embodiment.

Recently, there has been a demand for an increase in the refrigeration capacity of refrigeration cycle devices, and hermetically sealed rotary compressors are expected to be increased in compression capacity (air volume).

In general, however, if the compression capacity (air volume) of a hermetically sealed rotary compressor is increased, the whole body of the hermetically sealed rotary compressor inevitably becomes larger and requires a larger installation area, resulting in a bulky refrigeration cycle device.

The present invention has been made in view of these circumstances, and provides a hermetically sealed rotary compressor, configured so that enlargement of its installation area can be suppressed without failing to increase its compression capacity and the compressor body is less liable to topple if subjected to a load or moment, and a refrigeration cycle device comprising this hermetically sealed rotary compressor to form a refrigeration cycle such that it can be kept from becoming large in size.

In order to achieve the above object, a hermetically sealed rotary compressor of the present invention comprises a compressor body, configured so that an electric motor unit is accommodated in an upper part of a well-closed container and a compression mechanism section, which is driven by the electric motor unit through a shaft, is accommodated in a lower end portion of the well-closed container, a support leg disposed on a lower end portion of the well-closed container and comprising a mounting hole attached and secured to a mounting spot, and an accumulator disposed on a lateral part of the well-closed container. In the hermetically sealed rotary compressor, the overall height H of the compressor body, which is the height measured from the bottom surface of the support leg to the upper end of the compressor body, is set to be 2.5 or more times the outer diameter D of the compressor body ($H/D \geq 2.5$), the height Hg of the center of gravity of the compressor body, which is the height measured from the bottom surface of the support leg to the center of gravity of the compressor body, is set to be ½ or less the overall height H of the compressor body ($Hg \leq H/2$), and the hermetically sealed rotary compressor comprises four or more mounting holes, based on the fulfillment of the following expression:

$$Rc/\cos\theta < Rb,\ Rb < L, \quad (1)$$

where Rb is the support point radius of the support legs (distance from a longitudinal central axis of the compressor body to the center of the mounting hole of each of the support legs), Rc is the outer radius of the compressor body (distance from the longitudinal central axis of the compressor body to the outer peripheral surface of the compressor body), L is the distance from the longitudinal central axis of the compressor body to the longitudinal central axis of the accumulator, and θ is an angle (45° in the case of four equally spaced legs) half an angle formed between adjacent support legs about the longitudinal central axis.

The present embodiment will now be described with reference to the drawings.

FIG. 1 is a longitudinal sectional view of a hermetically sealed rotary compressor M, illustrating its internal structure. The hermetically sealed rotary compressor M comprises a compressor body 1, support legs 2 provided on the lower end portion of the compressor body 1, and accumulator 4 attached to the lateral part of the compressor body 1 by a mounting fixture 3. The hermetically sealed rotary compressor M is installed in such a manner that the support legs 2 are placed in predetermined mounting spots and mounted by means of fixtures (not shown).

The compressor body 1 comprises a well-closed container 5, electric motor unit 6 accommodated in the upper part of the well-closed container 5, compression mechanism section 7 accommodated in the lower part, and shaft 8 connecting the electric motor unit 6 and compression mechanism section 7. An oil reservoir section 9 that accommodates lubricating oil is formed in the bottom portion of the well-closed container 5, and the greater part of the compression mechanism section 7 is immersed in the lubricating oil.

The electric motor unit 6 comprises a rotor 10 fitted on the shaft 8 and a stator 11, the inner peripheral surface of which faces the outer peripheral surface of the rotor 10 with a small gap therebetween and the outer peripheral surface of which is fitted and secured in the well-closed container 5.

The compression mechanism section 7 comprises a main bearing 13 pivotally supporting a substantially middle portion of the shaft 8 for rotation relative to the well-closed container 5 and a sub-bearing 14 pivotally supporting the lower end portion of the shaft 8 for rotation relative to the well-closed container 5. Two cylinders 16A and 16B are arranged between the main bearing 13 and sub-bearing 14 with an intermediate partition plate 15 therebetween.

Respective bores of the upper cylinder 16A and lower cylinder 16B form cylinder chambers Sa and Sb, which each accommodate an eccentric portion of the shaft 8 and a roller 17 fitted on the eccentric portion. A blade 18, which is shown for the lower cylinder chamber Sb only, is elastically urged by a spring so that the distal end portion of the blade 18 is in sliding contact with the outer peripheral surface of roller 17.

Two refrigerant pipes P for suction extend from the accumulator 4. These refrigerant pipes P are connected to each other, penetrating the well-closed container 5, and communicate with the cylinder chambers Sa and Sb through suction guide passages in the cylinders 16A and 16B. Discharge valve mechanisms are attached individually to those parts of the main bearing 13 and sub-bearing 14 which face the cylinder chambers Sa and Sb, respectively, and are covered by valve covers.

On the other hand, the upper end portion of the shaft 8 projects upwardly from the upper end surface of the electric motor unit 6 and formed having a small diameter. A flat auxiliary oil separator plate 20 is mounted on this upwardly projecting portion of the shaft 8, and a rolling bearing K is fitted on the upper part that is narrowly spaced from the auxiliary oil separator plate 20.

A housing 21 is fitted on the outer peripheral surface of the rolling bearing K, and the outer end portion of the housing 21 is attached and secured to a support frame 22 mounted on the inner peripheral wall of the well-closed container 5. The rolling bearing K and housing 21 constitute an upper bearing member 23. The upper bearing member 23 and support frame 22 will be described in detail later.

Further, a main oil separator plate 24 is provided on the uppermost end portion of the shaft 8, and a bottom opening of a refrigerant pipe P for discharge faces the main oil separator plate 24 with a gap therebetween. The refrigerant pipe P penetrates the upper end of the well-closed container and extends therein. This refrigerant pipe P is connected to the upper end portion of the accumulator 4 via refrigeration cycle components shown in FIG. 2.

As the electric motor unit 6 of the hermetically sealed rotary compressor M constructed in this manner is energized, the rotor 10 is rotated, whereupon the shaft 8 rotates integrally with it. The roller 17 in each of the cylinder chambers Sa and Sb performs such an eccentric motion that the distal end portion of the blade 18 urged by the spring slidingly contacts the peripheral surface of the roller 17, thereby halving each of the cylinder chambers Sa and Sb.

An evaporated gas refrigerant is drawn from the accumulator 4 into one of regions divided by the blade 18 in each of the cylinder chambers Sa and Sb and is compressed as the roller 17 performs the eccentric motion. When the refrigerant is compressed to a predetermined pressure, the discharge valve mechanisms are opened so that the refrigerant is discharged into the well-closed container 5 through the valve covers. The gas refrigerant is guided from the well-closed container 5 into the refrigerant pipe P and circulates in a refrigeration cycle device R, which will be described later.

Figure 2:
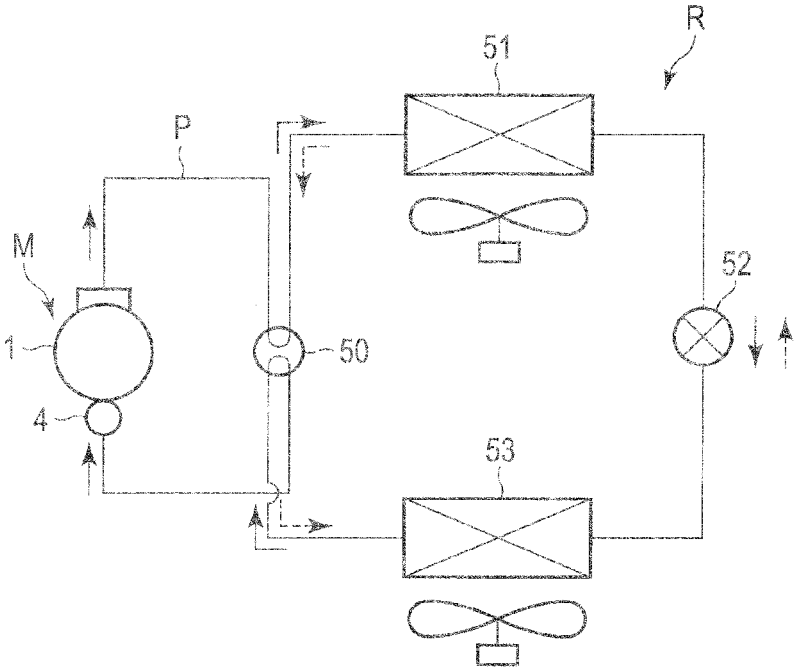
FIG. 2 is a refrigeration cycle diagram of the refrigeration cycle device according to the embodiment.

FIG. 2 is a refrigeration cycle diagram of the refrigeration cycle device R.

The compressor body 1 is connected with the hermetically sealed rotary compressor M comprising the accumulator 4, a four-way valve 50, an outdoor heat exchanger 51 for use as a heat-source-side heat exchanger, an expander 52, and an indoor heat exchanger 53 for use as a user-side heat exchanger by the refrigerant pipe P, thus forming a heat-pump refrigeration cycle.

In the refrigeration cycle device R described above, the refrigerant discharged from the hermetically sealed rotary compressor M is guided to the outdoor heat exchanger 51 through the four-way valve 50, as indicated by full-line arrows, during cooling operation. Thereupon, the refrigerant is condensed by heat exchange with outdoor air and changed into a liquid refrigerant. The liquid refrigerant derived from the outdoor heat exchanger 51 is guided to the expander 52, whereupon it is adiabatically expanded.

Then, the refrigerant is guided to the indoor heat exchanger 53, whereupon it is evaporated by heat exchange with indoor air introduced into it and takes evaporative latent heat from the indoor air, thereby cooling the interior of a room. The evaporated refrigerant derived from the indoor heat exchanger 53 is drawn into the hermetically sealed rotary compressor M through the four-way valve 50, and is compressed and circulated in the refrigeration cycle, as described above.

During heating operation, the four-way valve 50 is switched so that the gas refrigerant discharged from the hermetically sealed rotary compressor M circulates, as indicated by broken-line arrows. Specifically, the gas refrigerant is guided to the indoor heat exchanger 53 through the four-way valve 50 and condensed by heat exchange with the indoor air. The indoor air absorbs heat of condensation, thereby increasing its temperature and producing a room heating effect.

The liquid refrigerant derived from the indoor heat exchanger 53 is guided to the expander 52, in which it is adiabatically expanded. Then, it is guided to the outdoor heat exchanger 51 and evaporated. Thereafter, the liquid refrigerant is drawn into the hermetically sealed rotary compressor M through the four-way valve 50, and as described above, is compressed and circulated in the refrigeration cycle.

The following is a description of the configuration of the support legs 2 attached to the lower end portion of the compressor body 1 of the hermetically sealed rotary compressor M according to the present embodiment.

Figure 3A:
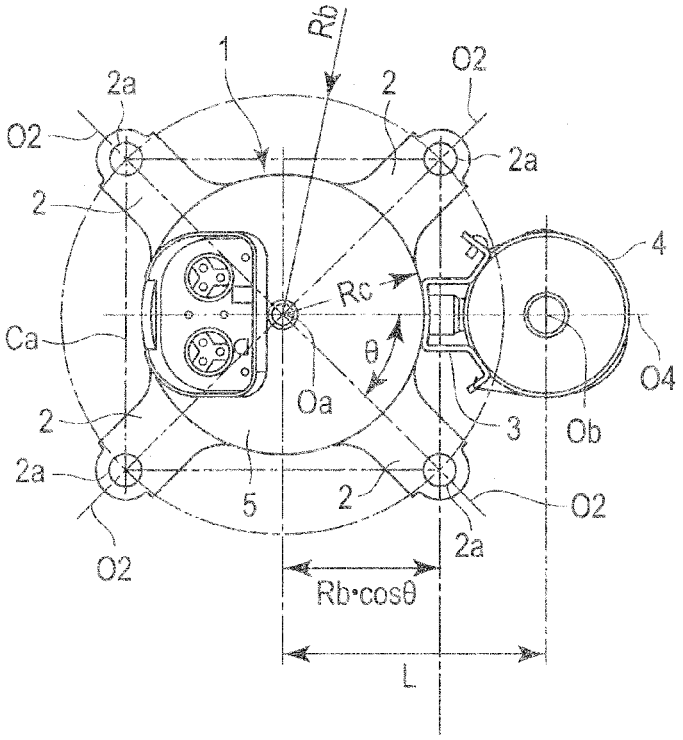
FIG. 3A is a plan view showing the hermetically sealed rotary compressor.
Figure 3B:
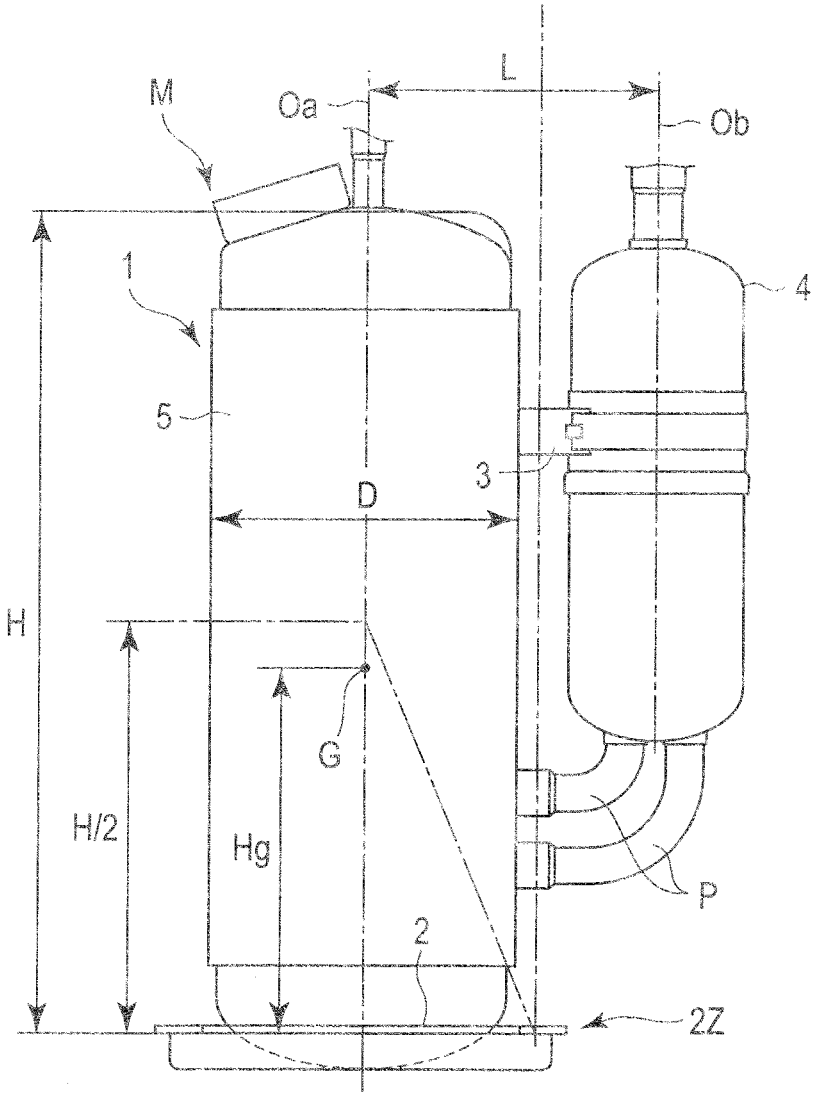
FIG. 3B is a front view showing the hermetically sealed rotary compressor.

FIG. 3A is a plan view of the hermetically sealed rotary compressor M, and FIG. 3B is a front view of the hermetically sealed rotary compressor M.

Here, a support section 2Z, which is an integral molding comprising the four projecting support legs 2, is attached to the lower end portion of the well-closed container 5 that constitutes the compressor body 1 by welding or other means. Alternatively, the support legs 2 may be independently mounted on the well-closed container 5.

As viewed in a plan view, the four support legs 2 project outwardly from the outer peripheral surface of the well-closed container 5. Since the support legs 2 are arranged at equal intervals, their respective central axes O2 are precisely spaced at regular intervals, of 90°. A central axis Oa in the longitudinal direction of the compressor body 1 (hereinafter simply referred to as the compressor body central axis) lies on extensions of the central axes O2 of the support legs 2.

Each support leg 2 is a piece with a substantially U-shaped cross-section bent to be downwardly open, and only its distal end comprises only a semicircular flat portion without a bent portion. A mounting hole 2*a* is disposed in the central position of each support leg 2 such that the center of the mounting hole 2*a* is located on the central axis O2 of the support leg 2.

In installing the hermetically sealed rotary compressor M in position, it is placed in a predetermined region with annular elastic members of rubber material or the like fitted individually into the mounting holes 2*a* of the support legs 2. Thus, that part of the lower surface of each support leg around the mounting hole 2*a* serves as a surface to be supported. The hermetically sealed rotary compressor M is installed in such a manner that fixtures are inserted into the elastic members and the support legs 2 are attached and secured.

In this case, the hermetically sealed rotary compressor M is supported in such a manner that the elastic members are fitted into the four mounting holes 2*a* in the four support legs 2, that is, the hermetically sealed rotary compressor M is four-point-supported.

The accumulator 4 is mounted by means of the mounting fixture 3 between the support leg 2 that projects diagonally upward to the right in FIG. 3A and the support leg 2 that projects diagonally downward to the right.

As shown in FIG. 3A, the distance from the compressor body central axis Oa to the outer peripheral surface of the compressor body 1 is referred to as the outer radius of the compressor body 1 and is designated Rc.

Thus, a central axis Ob in the longitudinal direction of the accumulator 4 (hereinafter simply referred to as the accumulator central axis) lies on a center line O4 that horizontally extends from the compressor body central axis Oa. The distance from the compressor body central axis Oa to the accumulator central axis Ob is designated L.

The distance from the compressor body central axis Oa to the center of the mounting hole 2*a* of each support leg 2 is referred to as the support point radius of the support leg 2 and is designated Rb.

As described above, the support legs 2 are precisely spaced at regular intervals of 90°, and based on the setting of the support point radius Rb of the support legs 2, segments Ca that individually connect the respective centers of the mounting holes 2*a* of the support legs 2 are illustrated as defining a square.

An angle half the angle defined between each two adjacent mounting hole 2*a* with respect to the compressor body central axis Oa is referred to as θ. In the present embodiment, the four support legs 2 are arranged at intervals of 90°, so that θ is an angle of 45°, which is half of 90°.

In the present embodiment, moreover, the accumulator central axis Ob is disposed at the center between the support leg 2 that projects diagonally upward to the right and the support leg 2 that projects diagonally downward to the right, as shown in FIG. 3A, an angle defined between the center line O4, which connects the compressor body central axis Oa and accumulator central axis Ob, and each of the support legs 2 that project diagonally upward and downward to the right in FIG. 3A is also 45°.

A horizontal distance from the compressor body central axis Oa to the center of the mounting hole 2*a* of each support leg 2, which is parallel to a line that halves the angle between each two adjacent support legs 2 with respect to the compressor body central axis Oa (also parallel to the center line O4 that connects the compressor body central axis Oa and accumulator central axis Ob in the present embodiment), based on the segments Ca of the square that connect the respective centers of the mounting holes 2*a* of the support legs 2, can be represented as $Rb \cdot \cos\theta$.

As shown in FIG. 3(B), on the other hand, the distance from the bottom surfaces of the support legs 2 (lower surfaces of the support legs 2 around the mounting holes 2*a*) to the upper end of the compressor body 1 is referred to as the overall height of the compressor body 1 and is designated H, and the outer diameter of the compressor body 1 is designated D. Further, the ratio of the overall height H of the compressor body 1 to the outer diameter D of the compressor body 1 is referred to as the aspect ratio of the compressor body 1.

The compressor body 1, which accommodates therein the electric motor unit 6 and compression mechanism section 7, is configured so that its center of gravity G is set in a predetermined region in the height direction. The distance from the bottom surfaces of the support legs 2 to the center of gravity G of the compressor body 1 is referred to as the height of the center of gravity of the compressor body 1 and is designated Hg.

Based on this setting, the hermetically sealed rotary compressor M is designed so that the following relational expression holds.

Here, the aspect ratio of the compressor body 1 is set to 2.5 or more. Specifically, the overall height H of the compressor body 1 is set to be 2.5 or more times as great as the outer diameter D of the compressor body 1 ($H/D \geq 2.5$). Furthermore, the height Hg of the center of gravity of the compressor body 1 is set to be ½ or less the overall height H of the compressor body 1 ($Hg \leq H/2$).

The higher the aspect ratio (H/D) of the compressor body 1, the more easily the hermetically sealed rotary compressor M falls down. In general, therefore, the aspect ratio of a compressor body is conventionally set to 2.3 or less. If the compression capacity of the compressor is increased, however, the outer diameter of the compressor body becomes greater, an installation area for the compressor inevitably increases, and the refrigeration cycle device becomes large in size.

Accordingly, the compression capacity of the compressor M can be increased without making the outer diameter D of the compressor body 1 very large, by setting the aspect ratio of the compressor body 1 to at least 2.5 or more, as described above.

As regards the problem of the liability of the hermetically sealed rotary compressor M to topple, it was ascertained that the compressor M can be made less liable to topple ting the height Hg of the center gravity of the compressor body 1 to be half or less the overall height H of the compressor body 1 and satisfying the following expression (a):

$$Rc<Rb\cdot\cos\theta. \quad (a)$$

Specifically, the horizontal distance Rb·cos θ from the compressor body central axis Oa to the center of the mounting hole 2*a* of each support leg 2, which is parallel to the line that halves the angle between each two adjacent support legs 2 with respect to the compressor body central axis Oa (also parallel to the center line O4 that connects the compressor body central axis Oa and accumulator central axis Ob in the present embodiment), based on the segments Ca of the square that connect the respective centers of the mounting holes 2*a* of the support legs 2, is set to be greater than the outer radius Rc of the compressor body 1.

Thus, expression (a) implies that the outer radius Rc of the compressor body 1 is inside the square segments Ca that individually connect the respective centers of the mounting holes 2*a* of the support legs 2.

The accumulator 4 is attached and secured to the compressor body 1 by the mounting fixture 3 and refrigerant pipes P for suction. If the hermetically sealed rotary compressor M is vertically dropped by accident, therefore, a vertical load is applied to the accumulator 4 and acts as a moment in such a direction as to bring down the compressor body 1.

The closer to the accumulator 4 than to the outer radius Rc of the compressor body 1 the segments Ca that connect the respective centers of the mounting holes 2*a* of the support legs 2 are then located, the lower the above-described moment is so that the hermetically sealed rotary compressor M can be made less liable to topple. These advantageous conditions can be obtained by satisfying expression (a).

Further, the following expression is set for the hermetically sealed rotary compressor M:

$$Rb<L. \quad (b)$$

Specifically, the support point radius Rb of the support legs 2 is set to be smaller than the distance from the compressor body central axis Oa to the accumulator central axis Ob.

This expression implies that the projection length of the support legs 2 is made shorter than the mounting position of the accumulator 4 so that an installation space for the compressor body 1 is reduced and an excessive enlargement of the installation space is suppressed.

Combining expression (a), Rc<Rb·cos θ, and expression (b), Rb<L, we obtain $$Rc<Rb\cdot\cos\theta,\ Rb<L.$$

The support point radius Rb of the support legs 2 is common to both these expressions. Combining the two expressions again with Rb left by dividing both sides of expression (a), in particular, by cos θ, we obtain $$Rc/\cos\theta<Rb,\ Rb<L. \quad (1)$$

Even if a load or moment is applied to the compressor body 1 and accumulator 4, the hermetically sealed rotary compressor M can be made less liable to topple without excessively enlarging the installation space for the hermetically sealed rotary compressor M.

The following is a comparison of cases where the above-described hermetically sealed rotary compressor M is four-point-supported and where the hermetically sealed rotary compressor M is, for example, three-point-supported (based on a structure comprising three support legs and three mounting holes). Naturally, the same minimum necessary set conditions are used for the cases of four-point support and three-point support.

Specifically, the overall height of the compressor body 1 is set to be 2.5 or more times as great as the outer diameter D of the compressor body 1 and the height Hg of the center of gravity of the compressor body 1 is set to be ½ or less the overall height H of the compressor body 1 for both of the cases of four-point support and three-point support.

Figure 4A:
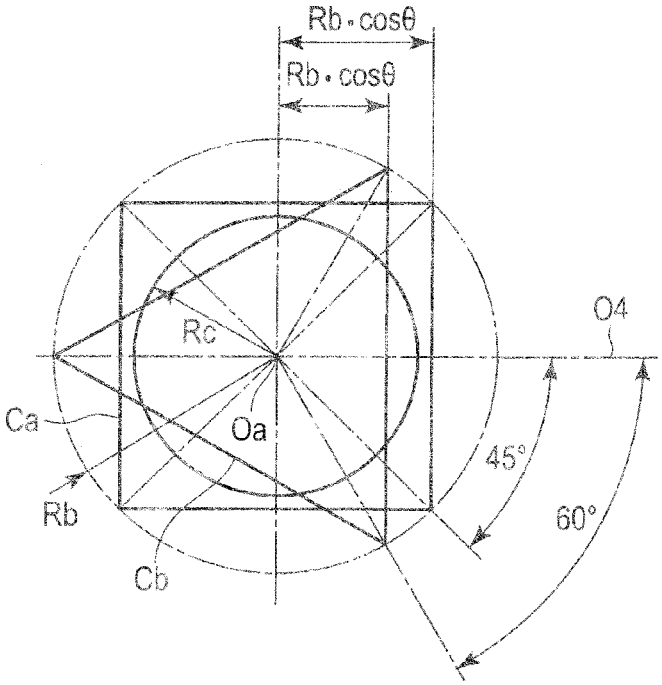
FIG. 4A is an explanatory diagram showing characteristics of support legs of the hermetically sealed rotary compressor.

Furthermore, FIG. 4A is a schematic view showing how the outer radius Rc of the compressor body 1 and the support point radius Rb of the support legs 2 are set to be equal for both of the cases of four-point support and three-point support.

Thus, the distance L from the compressor body central axis Oa to the accumulator central axis Ob, not shown here, is the same for both the cases.

As described above, the segments Ca that individually connect the respective centers of the mounting holes 2*a* of the support legs 2 for the case of four-point support are illustrated as defining a square. Further, segments Cb that individually connect respective centers F of mounting holes for three-point support are illustrated as defining a regular triangle.

However, the horizontal distance (Rb·cos θ) from the compressor body central axis Oa to the center of the mounting hole 2*a* of each support leg 2, which is parallel to the line that halves the angle between each two adjacent support legs 2 with respect to the compressor body central axis Oa, is inevitably shorter for the case of three-point support than for the case of four-point support.

In addition, it is evident that the distance (Rb·cos θ) for the case of three-point support is shorter than the outer radius Rc of the compressor body 1 (Rb·cos θ<Rc), as illustrated in the drawings.

In the hermetically sealed rotary compressor M, as described before, expression (a), Rc<Rb·cos θ, is satisfied so that the outer radius Rc of the compressor body 1 is inside the square segments Ca that individually connect the respective centers of the mounting holes 2*a* of the support legs 2, and therefore, the moment produced by vertical dropping of the hermetically sealed rotary compressor is so small that the compressor is less liable to topple.

Since expression (a) is not satisfied for the case of three-point support, although expression (a) is satisfied for the case of four-point support, the hermetically sealed rotary compressor M easily falls down when it is vertically dropped. Thus, it can be concluded that the three-point support structure is unavailable.

Figure 4B:
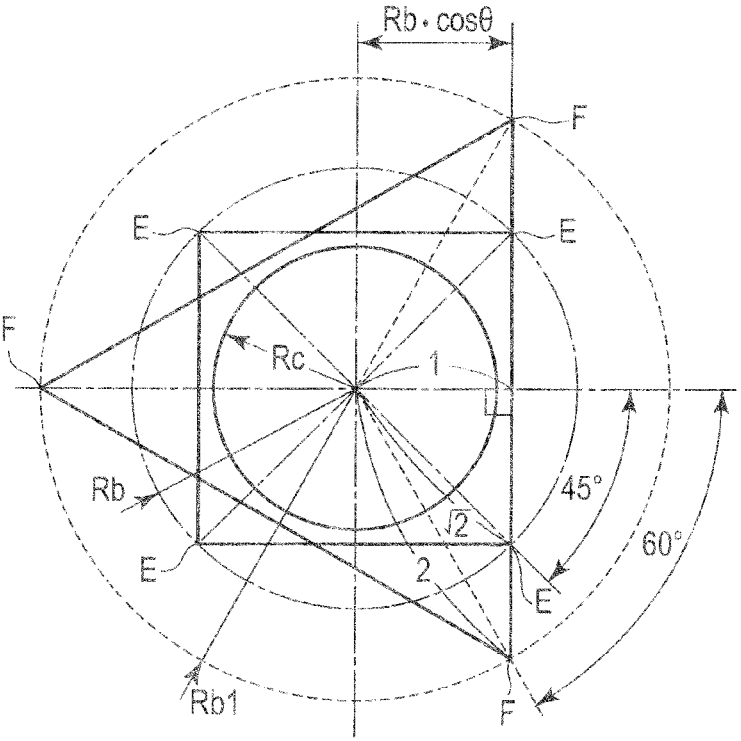
FIG. 4B is an explanatory diagram showing characteristics of the support legs of the hermetically sealed rotary compressor.

Thereupon, an attempt is made to adjust the distance Rb·cos θ for the case of three-point support to the distance Rb·cos θ for the case of four-point support, as shown in FIG. 4B, without changing the outer radius Rc of the compressor body 1, the overall length H of the compressor body 1 set to be 2.5 or more times as great as the outer diameter D of the compressor body 1, and the height Hg of the center of gravity of the compressor body 1 set to be ½ or less the overall height H of the compressor body 1.

In this way, expression (a), Rc<Rb·cos θ, can be satisfied for the case of three-point support, as well as for the case of four-point support.

In this case, however, the centers F of the mounting holes for three-point support are inevitably located outside respective centers E of the mounting holes for four-point support, so that a support point radius Rb1 of support legs for the case of three-point support is greater than the support point radius Rb of the support legs 2 for the case of four-point support (Rb<Rb1).

Actually, right triangles with one 90° vertical angle are imagined and a side Rb·cos θ is assumed to be the common base of right triangles for the case where the angle of the oblique side with respect to the base is 45° (four-point support) and the case where the angle is 60° (three-point support).

The respective lengths of the oblique sides of these right triangles correspond individually to the support point radius Rb of the support legs for four-point support and the support point radius Rb1 of the support legs for three-point support.

If the length of the base (side Rb·cos θ) of the right triangles the support point radius Rb of the support legs 2 for four-point support, that corresponds to the oblique side, is √2, and the support point radius Rb1 of the support legs 2 for three-point support is 2, based on the trigonometric ratio relationships.

Thus, the support point radius of the support legs 2 for four-print support, compared with that for three-point support, can be as short as (√2/2).

Since the area of a circle based on the support point radius of the support legs 2 can be represented by $\pi \cdot r^2$, each installation space is based on $(\sqrt{2}/2)^2 = 2/4 = 1/2$. Thus, the area of the installation space for the case of four-point support can be as small as ½ (half) that for the case of three-point support.

Thus, it can be concluded that the three-point support is unavailable due to many unfavorable conditions, compared with those of the four-point support. Five-point support (based on five support legs and five mounting holes) and supports based on more points, which are not particularly shown, are available because the installation space can be further reduced.

If the hermetically sealed rotary compressor M is adopted, as described above, the aspect ratio of the compressor body 1 can be increased so that enlargement of the installation area can be suppressed. The compressor is improved in stability such that it can be made less liable to topple even if a load or moment is applied to the compressor body 1 and accumulator 4. The refrigeration cycle device R comprising this hermetically sealed rotary compressor M is kept from becoming large in size so that its refrigeration capacity is increased.

In a hermetically sealed rotary compressor with a conventional structure, a substantially middle portion and lower end portion of a shaft are supported by a main bearing and sub-bearing that constitute a compression mechanism section. In contrast, the electric motor unit is only fitted on the upper part of the shaft and the upper end portion of the shaft is not supported, that is, the support structure is only a cantilever structure.

In the present embodiment, predetermined conditions are satisfied, the overall height H of the compressor body 1 is set high within a tolerance, and the installation space is minimized.

As the overall height H of the compressor body 1 is increased, however, the axial length of the shaft 8 becomes greater than in the conventional case. If only the substantially middle portion and lower end portion of the shaft 8 are supported, as in the conventional case, the extended upper part of the shaft 8 is liable to undergo a so-called whirling phenomenon during rotation.

To prevent this and improve stability, the rolling bearing K that constitutes the upper bearing member 23 is attached to the upper end portion of the shaft 8, and this rolling bearing K is supported by the housing 21. The housing 21 is attached to the inner peripheral wall of the well-closed container 5 by means of the support frame 22.

The upper bearing member 23 and support frame 22 will now be described in detail.

Figure 5:
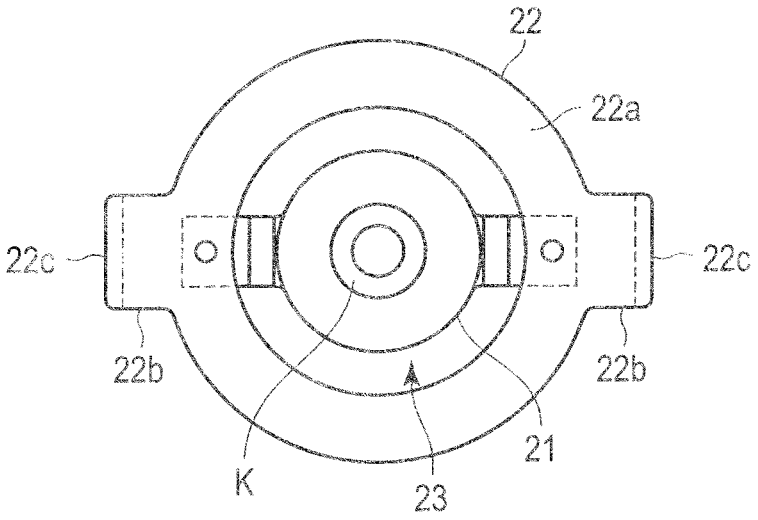
FIG. 5 is an explanatory diagram showing a mounting structure for an upper bearing member of the hermetically sealed rotary compressor.

FIG. 5 is a plan view showing the upper bearing member 23 and support frame 22.

The support frame 22 will be described first. Extended lugs 22*b* integrally extend outward from diametrically opposite side portions of the outer peripheral end of a flat plate 22*a* in the form of a circular ring in a plan view. An end edge of each extended lug 22*b* forms a downwardly bent piece 22*c*. The bent pieces 22*c* are brought into close contact with and attached and secured to the inner peripheral wall of the well-closed container 5.

Here, the housing 21 that constitutes the upper bearing member 23 is attached and secured to the extended lugs 22*b* or flat plate 22*a* of the support frame 22.

Figure 6A:
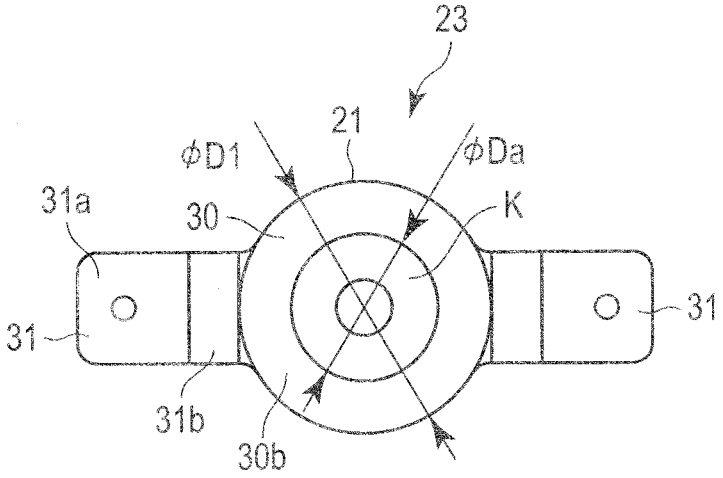
FIG. 6A is a plan view of the upper bearing member.
Figure 6B:
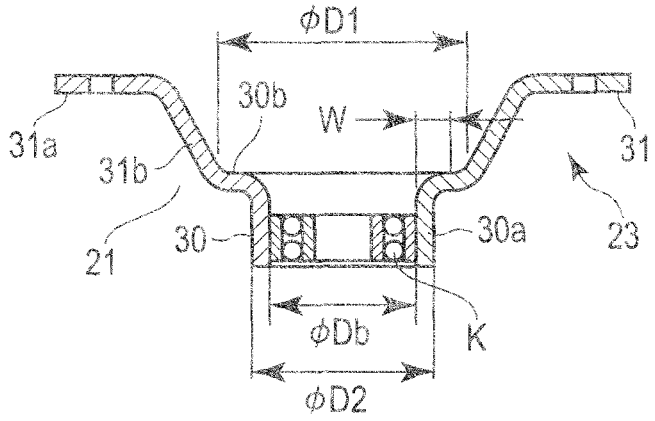
FIG. 6B is a longitudinal sectional view of the upper bearing member.
Figure 6C:
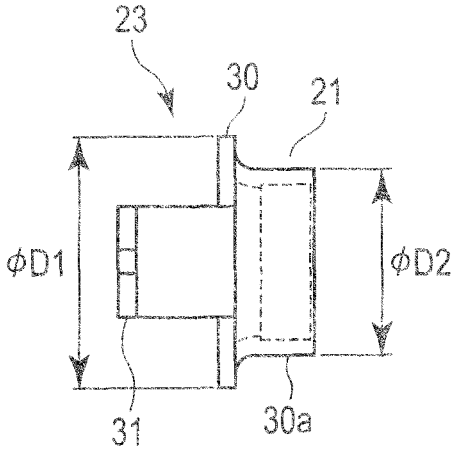
FIG. 6C is a side view of the upper bearing member.

FIG. 6A is a plan view of the upper bearing member 23, FIG. 6B is a longitudinal sectional view of the upper bearing member 23, and FIG. 6C is a side view of the upper bearing member 23.

As described above, the upper bearing member 23 is disposed between the upper part of the well-closed container 5 and the upper end surface of the electric motor unit 6, and comprises the rolling bearing K, which engages with the shaft 8, and the housing 21 holding the rolling bearing K relative to the well-closed container 5.

The housing 21 comprises a bearing holding portion 30 holding the rolling bearing K and mounting leg portions 31 provided integrally on the bearing holding portion 30 and attached and secured to the well-closed container 5 by the support frame 22.

The bearing holding portion 30 comprises a ring-shaped fitting portion 30*a* fitted on and secured to the outer ring of the rolling bearing K, and the lower end edge of the fitting portion 30*a* is arranged substantially flush with the lower end surface of the rolling bearing K. The upper end portion of the fitting portion 30*a* projects above the upper end surface of the rolling bearing K and is bend-formed in a circle along the entire peripheral surface on the upper end of the fitting portion 30*a*.

The region integrally bend-formed on the upper end of the fitting portion 30*a* is formed so that outer peripheral diameter D1 of its upper part is greater than outer peripheral diameter D2 of its lower part and forms an inclined receiving portion 30*b* inclined so that the inner peripheral end of the upper part is lower than the outer peripheral end of the upper part.

As for the housing 21, it is configured to satisfy the following expression:

$$W \geq (D1 - Db)/4, \quad (2)$$

where W is the width of the inclined receiving portion 30*b*, D1 is the outer peripheral diameter of the upper part, and Db is the outer diameter of the rolling bearing K.

On the other hand, the mounting leg portions 31 are pieces of a predetermined width located above the bearing holding portion 30. The upper end of each mounting leg portion 31 forms a horizontally bent securing piece 31*a*, and an inclined leg portion 31*b* is formed inclined downward from the securing piece 31*a* toward the bearing holding portion 30. Thus, the lower end of the inclined leg portion 31*b* is integrally combined with the rolling bearing holding portion 30.

The upper bearing member 23 is constructed in this manner, and the upper end portion of the shaft 8 is fitted in the inner ring of the rolling bearing K and attached and secured to the well-closed container 5 through the well-closed container 5.

The axial length of the shaft 8 increases with increase in the overall height H of the compressor body 1. Since the main bearing 13, sub-bearing 14, and upper bearing member 23 support the substantially middle portion, lower end portion, and upper end portion, respectively, of the shaft 8, the shaft can be smoothly rotated without runout. Thus, the rotational accuracy of the shaft 8 can be improved.

In the hermetically sealed rotary compressor H of this type, moreover, the greater part of the compression mechanism section 7 is immersed in the lubricating oil in the oil reservoir section 9 formed at the inner bottom portion of the well-closed container 5. Therefore, both the main bearing 13 and the sub-bearing 14, which constitute the compression mechanism section 7, are immersed in the lubricating oil, and individual sliding contact portions of the compression mechanism section 7 can be fully oiled through oil passages in the shaft 8 and bearings 13 and 14.

Since the upper bearing member 23 is located further above the electric motor unit 6 that is disposed above the compression mechanism section 7, the lubricating oil cannot be actually supplied even though the shaft 8 is provided with the oil passages that communicate with the upper bearing member 23. Thus, the lubricating oil cannot be pumped up so that it reaches the upper bearing member 23 even if the shaft 8 is rotated at an extremely high speed.

However, the high-temperature, high-pressure gas refrigerant compressed by the compression mechanism section 7 is temporarily discharged and filled into the well-closed container 5 and fills it. As the compressed gas refrigerant is continuously discharged into the well-closed container 5, the gas refrigerant having been filling the well-closed container 5 is led out into the refrigerant pipe P for discharge.

The gas refrigerant discharged from the compression mechanism section 7 is mixed with some of the lubricating oil supplied to the compression mechanism section 7 and floats as an oil mist. This oil mist adheres to the support frame 22 and upper bearing member 23 and expands with the passage of time. Then, the oil mist forms drops, some of which drip from the support frame 22 and upper bearing member 23 and return to the oil reservoir section 9 by flowing down the electric motor unit 6.

Further, there is an oil mist that adheres to the housing 21 constituting the upper bearing member 23. If these oil mists expand and form drops, the drops flow down from the securing pieces 31*a* on the upper ends of the mounting leg portions 31 to the inclined leg portions 31*b*. The lubricating oil drops are guided from the inclined leg portions 31*b* to the inclined receiving portion 30*b* of the bearing holding portion 30 and intensively supplied to the rolling bearing K.

The inclined receiving portion 30*b* of the bearing holding portion 30, which is integrally combined with the inclined leg portion 31*b* of the mounting leg portion 31, is formed so that outer peripheral diameter D1 of the upper part is greater than outer peripheral diameter D2 of the lower part, and is inclined so that the inner peripheral end of the upper part is lower than the outer peripheral, end of the upper part.

As for the housing 21, moreover, it is configured to satisfy the following expression:

$$W \geq (D1 - Db)/4, \quad (2)$$

where W is the width of the inclined receiving portion 30*b*, D1 is the outer peripheral diameter of the upper part, and Db is the outer diameter of the rolling bearing K.

Based on these set conditions, the lubricating oil guided to the inclined receiving portion 30*b* reliably flows into the rolling bearing K and serves for lubrication. Although the upper bearing member 23, unlike the main bearing 13 and sub-bearing 14, cannot be supplied directly with the lubricating oil in the oil reservoir section 9, it can be oiled by using the oil mist floating in the well-closed container 5, whereby the reliability of the rolling bearing K can be improved.

According to the present invention, there are provided a hermetically sealed rotary compressor, configured so that enlargement of its installation area can be suppressed without failing to increase its compression capacity and the compressor body is less liable to topple if subjected to a load or moment, and a refrigeration cycle device comprising this hermetically sealed rotary compressor to form a refrigeration cycle such that it can be kept from becoming large in size.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A hermetically sealed rotary compressor comprising:

a compressor body comprising a well-closed container;

an electric motor unit accommodated in an upper part of the well-closed container;

a compression mechanism section comprising a cylinder forming a cylinder chamber and a roller driven by the electric motor unit through a shaft to perform an eccentric motion in the cylinder chamber, the compression mechanism section being accommodated in a lower end portion of the well-closed container;

first, second, third, and fourth support legs welded to the lower end portion of the well-closed container, each of the first, second, third, and fourth support legs comprising a mounting through hole for attaching and securing the hermetically sealed rotary compressor to a mounting spot, and the first, second, third, and fourth support legs being arranged at regular intervals along a circumference of the well-closed container;

an accumulator disposed on a lateral part of the well-closed container, the lateral part corresponding to a center between the first and second support legs, which are adjacent to each other;

an upper bearing member disposed between the upper part of the well-closed container and the electric motor unit, the upper bearing member comprising:

a rolling bearing engaged with the shaft;

a support frame attached to an inner peripheral wall of the well-closed container; and a housing attached to the inner peripheral wall of the well-closed container by the support frame, the housing supporting the rolling bearing, and the housing including a bearing holding portion and mounting leg portions;

a refrigerant pipe provided on the upper part of the well-closed container, to which a gas refrigerant containing an oil mist travels from the compression mechanism section; and an oil separator plate disposed between the refrigerant pipe and the rolling bearing, wherein:

the bearing holding portion comprises a ring-shaped fitting portion fitted on the rolling bearing and an inclined receiving portion, the inclined receiving portion being bent outward from an upper end of the fitting portion and being inclined so that an inner peripheral end of an upper part of the inclined receiving portion is lower than an outer peripheral end of the upper part of the inclined receiving portion, the mounting leg portions each have a predetermined width, are located above the bearing holding portion, are combined with an outer peripheral end of the bearing holding portion, and are attached to the support frame, the support frame includes a flat circular ring plate to which the mounting leg portions are attached, an overall height H of the compressor body, which is a height measured from a bottom surface of the first, second, third, and fourth support legs to an upper end of the compressor body, is set to be at least 2.5 times greater than an outer diameter D of the compressor body ($H/D \geq 2.5$), a height Hg of a center of gravity of the compressor body, which is a height measured from the bottom surface of the first, second, third, and fourth support legs to the center of gravity of the compressor body, is set to be ½ or less than the overall height H of the compressor body ($Hg \leq H/2$), and the hermetically sealed rotary compressor satisfies the following expression (1):

$$Rc/\cos\theta < Rb,\ Rb < L, \quad (1)$$

where Rb is a distance from a longitudinal central axis of the compressor body to a center of the mounting through hole of each of the first, second, third, and fourth support legs, Rc is a distance from the longitudinal central axis of the compressor body to an outer peripheral surface of the compressor body, L is a distance from the longitudinal central axis of the compressor body to a longitudinal central axis of the accumulator, and θ is an angle (45°) of half an angle formed between the first and second support legs about the longitudinal central axis of the compressor body.

2. The hermetically sealed rotary compressor according to claim 1, wherein the mounting leg portion is integrally combined with an outer peripheral edge of an upper part of the inclined receiving portion such that an outer end portion of the mounting leg portion is attached and secured to the well-closed container, and the mounting leg portion is located above the bearing holding portion and inclined downward from the outer end portion thereof toward the inclined receiving portion.

3. A refrigeration cycle device comprising the hermetically sealed rotary compressor according to claim 1, a heat-source-side heat exchanger, an expander, and a user-side heat exchanger.

4. The hermetically sealed rotary compressor according to claim 1, wherein the oil separator plate is provided on an upper end portion of the shaft.

5. The hermetically sealed rotary compressor according to claim 1, wherein the oil separator plate faces the inclined receiving portion from above such that oil mist adhered to a lower surface of the oil separator partly expands and drops onto an upper surface of the inclined receiving portion which guides a drop of lubricating oil to the rolling bearing.

* * * * *